US011819979B2

(12) United States Patent
Nakamatsu

(10) Patent No.: US 11,819,979 B2
(45) Date of Patent: Nov. 21, 2023

(54) ABRASIVE TOOL

(71) Applicant: A.L.M.T. Corp., Tokyo (JP)

(72) Inventor: Sadateru Nakamatsu, Kato (JP)

(73) Assignee: A.L.M.T. Corp., Tokyo (JP)

( * ) Notice: Subject to any disclaimer, the term of this patent is extended or adjusted under 35 U.S.C. 154(b) by 1062 days.

(21) Appl. No.: 16/078,462

(22) PCT Filed: Dec. 7, 2016

(86) PCT No.: PCT/JP2016/086372
§ 371 (c)(1),
(2) Date: Aug. 21, 2018

(87) PCT Pub. No.: WO2017/145491
PCT Pub. Date: Aug. 31, 2017

(65) Prior Publication Data

US 2019/0054592 A1 Feb. 21, 2019

(30) Foreign Application Priority Data

Feb. 22, 2016 (JP) ..... 2016-031032

(51) Int. Cl.

| | |
|---|---|
| ***B24D 3/06*** | (2006.01) |
| ***B24D 5/02*** | (2006.01) |
| ***B24D 3/00*** | (2006.01) |
| ***B24B 53/12*** | (2006.01) |
| ***B24D 5/00*** | (2006.01) |
| ***B24B 53/075*** | (2006.01) |

(52) U.S. Cl.
CPC ..... *B24D 3/06* (2013.01); *B24B 53/075* (2013.01); *B24B 53/12* (2013.01); *B24D 3/00* (2013.01); *B24D 5/00* (2013.01); *B24D 5/02* (2013.01); *B24D 2203/00* (2013.01)

(58) Field of Classification Search
CPC ..... B24D 3/06; B24D 3/00; B24D 5/00
See application file for complete search history.

(56) References Cited

U.S. PATENT DOCUMENTS

| | | | |
|---|---|---|---|
| 5,453,312 | A | 9/1995 | Haas et al. |
| 5,549,961 | A | 8/1996 | Haas et al. |
| 6,012,972 | A | 1/2000 | Jankowski |

(Continued)

FOREIGN PATENT DOCUMENTS

| | | | |
|---|---|---|---|
| CN | 1102800 | A | 5/1995 |
| CN | 1209471 | A | 3/1999 |

(Continued)

OTHER PUBLICATIONS

Chosakai, New Machining Tool Dictionary (Industrial Research Center of Japan), 1991, pp. 651-654.

(Continued)

*Primary Examiner* — Pegah Parvini
(74) *Attorney, Agent, or Firm* — McCarter & English, LLP; Michael A. Sartori

(57) ABSTRACT

An abrasive tool has an abrasive grain layer comprising a plurality of hard abrasive grains bonded by a binder, with a plurality of the hard abrasive grains each having a working surface formed to contact a workpiece, a ratio of a total area of a plurality of such working surfaces to an area of an imaginary plane smoothly connecting the plurality of working surfaces being 5% or more and 30% or less.

9 Claims, 2 Drawing Sheets

(56) References Cited

U.S. PATENT DOCUMENTS

| | | | | |
|---|---|---|---|---|
| 6,319,108 | B1 * | 11/2001 | Adefris | B24D 3/10 451/526 |
| 6,368,198 | B1 * | 4/2002 | Sung | B24B 53/12 451/41 |
| 6,386,953 | B1 | 5/2002 | Wirz | |
| 6,419,574 | B1 | 7/2002 | Takahashi et al. | |
| 2003/0019570 | A1 | 1/2003 | Chen et al. | |
| 2008/0041354 | A1 | 2/2008 | Imal et al. | |
| 2008/0271384 | A1 | 11/2008 | Puthanangady et al. | |
| 2009/0047877 | A1 | 2/2009 | Muldowney | |
| 2009/0053980 | A1 | 2/2009 | Hwang et al. | |
| 2009/0215366 | A1 | 8/2009 | Ishizuka | |
| 2012/0060426 | A1 | 3/2012 | Puthanangady et al. | |
| 2015/0283666 | A1 * | 10/2015 | Nakajima | B24B 27/0633 125/21 |
| 2015/0290771 | A1 * | 10/2015 | Li | B24D 3/06 51/297 |
| 2015/0291867 | A1 * | 10/2015 | Breder | B24D 3/14 51/307 |
| 2016/0176018 | A1 | 6/2016 | Rudolf et al. | |
| 2018/0043506 | A1 * | 2/2018 | Hoshika | B24D 5/02 |

FOREIGN PATENT DOCUMENTS

| | | | |
|---|---|---|---|
| CN | 1286158 | A | 3/2001 |
| CN | 1400636 | A | 3/2003 |
| CN | 101001720 | A | 7/2007 |
| CN | 101247923 | A | 8/2008 |
| CN | 101367202 | A | 2/2009 |
| CN | 101508087 | A | 8/2009 |
| CN | 101563188 | A | 10/2009 |
| CN | 102825547 | A | 12/2012 |
| CN | 103846817 | A | 6/2014 |
| CN | 104097152 | A | 10/2014 |
| CN | 105612028 | A | 5/2016 |
| GB | 2326166 | A | 12/1998 |
| JP | H05-269666 | A | 10/1993 |
| JP | H06-114739 | A | 4/1994 |
| JP | H07-237128 | A | 9/1995 |
| JP | 2679178 | B2 | 11/1997 |
| JP | H10-058231 | A | 3/1998 |
| JP | 2000-246636 | A | 9/2000 |
| JP | 2002-292570 | A | 10/2002 |
| JP | 2003-089064 | A | 3/2003 |
| JP | 2003-200352 | A | 7/2003 |
| JP | 2003-260663 | A | 9/2003 |
| JP | 2004-130475 | A | 4/2004 |
| JP | 2005-161449 | A | 6/2005 |
| JP | 2005-279842 | A | 10/2005 |
| JP | 2007/307701 | A | 11/2007 |
| JP | 4215570 | B2 | 1/2009 |
| JP | 4354482 | B2 | 10/2009 |
| WO | 2007/000831 | A1 | 1/2007 |
| WO | 2007/119886 | A1 | 10/2007 |
| WO | 2015/018627 | A1 | 2/2015 |

OTHER PUBLICATIONS

Hirakawa, "Diamond/CBN products-Grain sizes of diamond or cubic boron nitride, JIS B 4130" Japanese Standards Association, 1998, pp. 1-10 [Cited in OA dated Mar. 12, 2018 in corresponding Japanese application].

Brochure of "Sysmex, Rapid particle size and shape analysis of suspensions FPIA-3000/FPIA-3000S", Malvern Instruments Ltd., pp. 2-7 [Cited in OA dated Mar. 12, 2018 in corresponding Japanese application].

Measurement result according to FPIA-3000S, Sysmex, 2018 [Cited in OA dated Mar. 12, 2018 in corresponding Japanese application].

Measurement result of equivalent circle diameter, 2018 [Cited in OA dated Mar. 12, 2018 in corresponding Japanese application].

Inoue, "Optimum Dressing Condition of Vitrified CBN Wheel for Higher Performance in High Efficiency Grinding", Journal of the Japan Society for Precision Engineering, vol. 58, No. 4. 1992, JSPE-5804 '92-04-586, pp. 20-24 [Cited in OA dated Mar. 12, 2018 in corresponding Japanese application].

Zhao et al., "Truing of Resinold-Bonded CBN Wheels" (1st Report, Cutting Edge Shape after Truing), Transactions of the Japan Society of Mechanical Engineers (C edition), vol. 62, No. 601, 1996-9, No. 96-0396, pp. 347-352 [Cited in OA dated Mar. 12, 2018 in corresponding Japanese application].

Takashima et al., "High-speed mirror grinding with CBN wheel (7th Report)—Influence of grain size of diamond rotary dresser on ground the surface—", Proceedings of 2005 JSPE Spring Academic Lecture Meeting, pp. 893-894 [Cited in OA dated Mar. 12, 2018 in corresponding Japanese application].

In et al., "Surface Characteristics of the Polyurethane Polisher in Mirror-Polishing Process,—Study on Super-Smooth Polishing Methods (2nd Report)—", Journal of the Japan Society for Precision Engineering, vol. 65, No. 8, 1999, pp. 1147-1152 [Cited in OA dated Mar. 12, 2018 in corresponding Japanese application].

Notification of the Third Office Action issued in counterpart CN Patent Application No. 201680082285.5 dated Dec. 11, 2020.

Notification to Grant Patent Right for Invention issued in counterpart Chinese Patent Application No. 201680082285.5 dated Mar. 16, 2021.

Notification of the First Office Action issued in counterpart Chinese Application 201680082285.5 dated Aug. 30, 2019.

Notification of the Second Office Action issued in counterpart Chinese Patent Application No. 201680082285.5 dated May 20, 2020.

Extended European Search Report of Application No. EP16891647.6, dated Jul. 16, 2019, 8 pages.

* cited by examiner

ABRASIVE TOOL

TECHNICAL FIELD

The present invention relates to an abrasive tool. The present application claims priority based on Japanese Patent Application No. 2016-031032 filed on Feb. 22, 2016. The Japanese patent application is entirely incorporated herein by reference. More specifically, the present invention relates to an abrasive tool comprising a plurality of abrasive grains bonded by a binder.

BACKGROUND ART

Conventionally, for example, diamond rotary dressers are disclosed in "New Machining Tool Dictionary," Kabushiki Kaisya Sangyo Chyosakai, published on Dec. 5, 1991 (NPD 1), and Japanese Patent Laying-open Nos. 5-269666 (PTD 1), 10-058231 (PTD 2) and 2000-246636 (PTD 3).

Conventional diamond rotary dressers for gears have a problem of short lifetime in some cases depending on a condition under which the dresser is used.

Accordingly, what provides a long-life diamond rotary dresser for a gear is disclosed in International Publication No. 2007/000831 (PTD 4).

CITATION LIST

Patent Documents

[PTD 1] Japanese Patent Laying-Open No. 5-269666

[PTD 2] Japanese Patent Laying-Open No. 10-058231

[PTD 3] Japanese Patent Laying-Open No. 2000-246636

[PTD 4] International Publication No. 2007/000831

Non Patent Document

[NPD 1] "New Machining Tool Dictionary," Kabushiki Kaisya Sangyo Chyosakai, Dec. 5, 1991, pp. 651-654

SUMMARY OF INVENTION

According to one aspect of the present invention, an abrasive tool is an abrasive tool having an abrasive grain layer comprising a plurality of hard abrasive grains bonded by a binder, with a plurality of the hard abrasive grains each having a working surface formed to contact a workpiece, a ratio of a total area of a plurality of such working surfaces to an area of an imaginary plane smoothly connecting the plurality of working surfaces being 5% or more and 30% or less.

DETAILED DESCRIPTION

Figure 1:
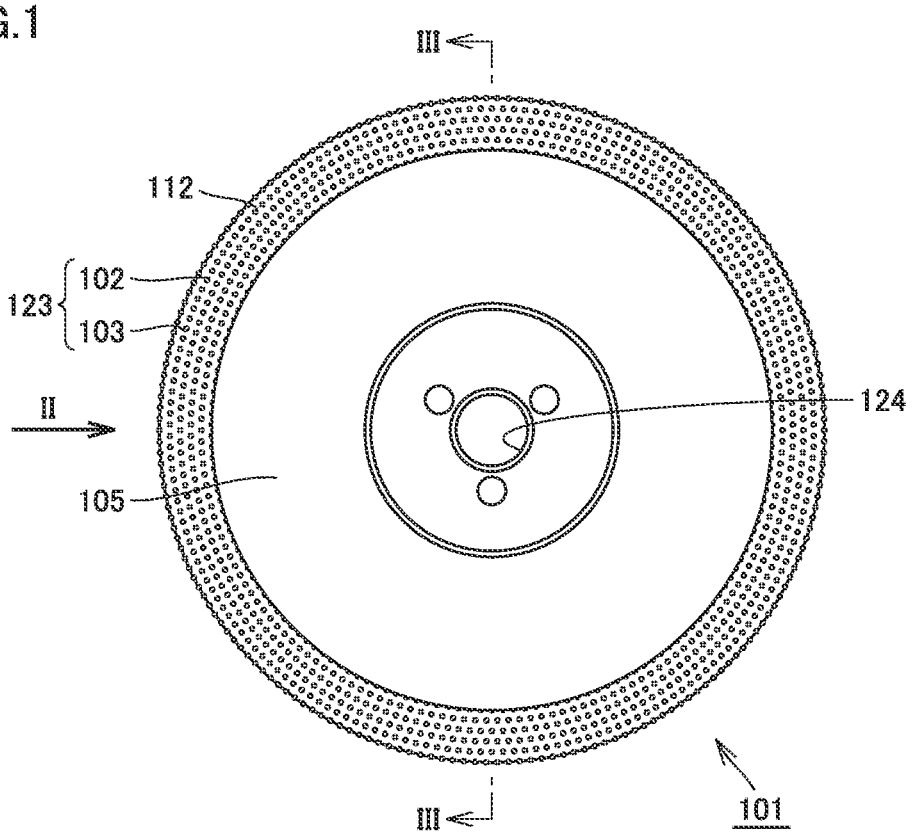
FIG. 1 is a front view of a diamond rotary dresser for a gear as an abrasive tool according to an embodiment of the present invention.

Problem to be Solved by the Present Disclosure

Conventional rotary dressers may have large variation in sharpness and lifetime, and they were impaired in sharpness at an early stage depending on the production lot and unable to transfer a shape to a grinding wheel accurately, and had reduced lifetime and other problems in some cases. Even the diamond rotary dresser of PTD 4 had a possibility of variation in sharpness and lifetime.

The present invention has been made to solve the above-mentioned problem, and it is an object of the present invention to provide an abrasive tool, such as a diamond rotary dresser, which has a long lifetime and also presents satisfactory sharpness.

Advantageous Effect of the Present Disclosure

The present invention can provide an abrasive tool, such as a diamond rotary dresser, which has a long lifetime and little variation in sharpness and lifetime and hence presents steady performance.

Description of Embodiments

Initially, embodiments of the present invention will be enumerated and described.

An abrasive tool is an abrasive tool having an abrasive grain layer comprising a plurality of hard abrasive grains bonded via a binder, with a plurality of the hard abrasive grains each having a working surface formed to contact a workpiece, a ratio of a total area of a plurality of such working surfaces to an area of an imaginary plane smoothly connecting the plurality of working surfaces being 5% or more and 30% or less.

The area of the working surface of each hard abrasive grain present per unit area of the imaginary plane of a surface of the abrasive grain layer (a total area of working surfaces of hard abrasive grains/the area of the imaginary plane) is calculated as follows: A microscope is used and the abrasive grain layer has the surface exposed to light in the direction of a normal thereto. Light scattered from other than the working surfaces is removed and only a reflection image from the working surfaces in the surface of the abrasive grain layer is analyzed and extracted to calculate the area ratio.

In order to specifically measure the area ratio, an observation is done in the imaginary plane at any three locations each in a field of view of 2 mm×2 mm and working surfaces' areas are measured in the above method, and "a total value of the working surfaces/a total value of the imaginary plane" is presented as the area ratio. The abrasive tool thus configured has optimally controlled an abrasive area acting when processing, and thus has little variation in sharpness and can also have a steady, long lifetime. If the above ratio is less than 5%, the area of working surfaces acting on processing is too small, and the abrasive tool has a reduced lifetime. If the above ratio exceeds 30%, the area of the working surfaces is too large, and sharpness deteriorates.

Preferably, a ratio of a maximum diameter to a minimum diameter (maximum diameter/minimum diameter) of a plurality of hard abrasive grains used for the abrasive tool is 1.2 or more and 10 or less. When the above ratio is 1.2 or more, the grain diameter of the hard abrasive grain can be kept large and hence satisfactory sharpness can be maintained. When the ratio is 10 or less, abrasive grain distribution variation can be kept small. As a result, the tool can be improved in precision. As an example of a method for measuring a grain diameter, there is a method to remove hard abrasive grains from an abrasive tool to determine image data of the hard abrasive grains, and an equivalent circle diameter of the hard abrasive grain is taken as the grain diameter. The maximum and minimum diameters of the hard abrasive grains are measured as follows:

First, the abrasive tool is cut in half, and one half of the abrasive tool has the abrasive grain layer molten to remove hard abrasive grains. Hard abrasive grains of 20% in mass of the removed hard abrasive grains are randomly extracted. Electronic data of an image of the extracted hard abrasive grains is generated using an optical microscope. Based on this image data, an equivalent circle diameter of the hard abrasive grain is measured with a dry-type grain image analyzer, and the equivalent circle diameter is measured as the grain diameter. Note that an equivalent circle diameter is a diameter of a hard abrasive grain measured and analyzed with a dry-type grain image analyzer, based on an image of the hard abrasive grain, and it is a diameter of a circle having the same area as the area of an image of each abrasive grain having a non-circular, deformed shape, and this diameter serves as a grain diameter. A maximum diameter DMAX and a minimum diameter DMIN in the measured grain diameter data are calculated and DMAX/DMIN indicates the maximum diameter/the minimum diameter.

Thus, the hard abrasive grains present in the abrasive grain layer do not have a uniform grain diameter; rather, the hard abrasive grains have a grain diameter varying within some range so that individual hard abrasive grains can be abraded at different speeds in different conditions, and when the abrasive grain layer is seen as a whole, it can have steady sharpness over a long period of time.

Preferably, the plurality of hard abrasive grains are distributed in the abrasive grain layer at a density of 50 to 1500 grains/$cm^2$. The distribution density is measured as follows: The surface of the abrasive grain layer is observed with a microscope. The size of the field of view to be observed is set in magnification such that 20 to 50 hard abrasive grains can be seen in the field of view and the number of hard abrasive grains is counted at each of any three locations. Then, based on the size of the field of view and the number of hard abrasive grains, the density of the hard abrasive grain distribution is calculated.

Preferably, the plurality of hard abrasive grains have a Vickers hardness Hv of 1000 or more and 16000 or less.

Representative examples of a hard abrasive grain having such a Vickers hardness include diamond, cubic boron nitride (cBN), SiC, $Al_2O_3$, and the like. The hard abrasive grain may be either a single crystal or a polycrystal.

Preferably, the plurality of hard abrasive grains have a grain size of 91 or more and 1001 or less, as defined in JIS B 4130 (1998), "table 1: types and indications of grain size," "1. narrow range." Specifically, see Table 1 below.

TABLE 1

| grain size | dimension of opening of sieve (μm) |
|---|---|
| 1001 | 1000/850 |
| 851 | 850/710 |
| 711 | 710/600 |
| 601 | 600/500 |

TABLE 1-continued

| grain size | dimension of opening of sieve (μm) |
|---|---|
| 501 | 500/425 |
| 426 | 425/355 |
| 356 | 355/300 |
| 301 | 300/250 |
| 251 | 250/212 |
| 213 | 212/180 |
| 181 | 180/150 |
| 151 | 150/125 |
| 126 | 125/106 |
| 107 | 106/90 |
| 91 | 90/75 |

dimension of opening of sieve according to JIS Z 8801

The grain size is measured in the following method: initially, as done in the method of measuring the maximum and minimum diameters of the hard abrasive grains, the abrasive tool is cut in half, and one half of the abrasive tool has the abrasive grain layer molten to remove hard abrasive grains. The removed hard abrasive grains are then measured based on a provision of JIS B 4130 (1998).

Preferably, the abrasive grain layer is a single layer.

Preferably, the binder is nickel plating.

Preferably, the abrasive tool is a rotary dresser.

Preferably, the rotary dresser is a disk dresser.

Preferably, it is used for one or both of truing and dressing of a grinding wheel used for processing a gear.

Detailed Description of Embodiments

The abrasive tool described below is an abrasive tool that can achieve steady sharpness and a long lifetime by controlling abrasive grains brought into contact with a workpiece to have an optimum state. That is, it is an abrasive tool in which abrasive grains acting when processing have an area, a grain diameter, a grain size distribution and a distribution density controlled to have an optimum state.

FIG. 1 is a front view of a diamond rotary dresser for a gear as an abrasive tool according to an embodiment of the present invention. With reference to FIG. 1, a diamond rotary dresser 101 for a gear according to the embodiment has a disk-shaped core 105, and on an outer periphery of core 105, a diamond layer serving as an abrasive grain layer 123 is provided to extend in the circumferential direction. Abrasive grain layer 123 is composed of a binder 103 composed of a nickel plating layer and hard abrasive grains 102 composed of diamond exposed from binder 103. In the front view shown in FIG. 1, a surface 112 acting on a workpiece appears, and another surface not shown in FIG. 1 is provided on the side opposite to surface 112. In FIG. 1, abrasive grain layer 123 has a uniform width in the radial direction, however, it is not necessary to always have a uniform width and a wide width portion and a narrow width portion may be provided as necessary.

Figure 2:
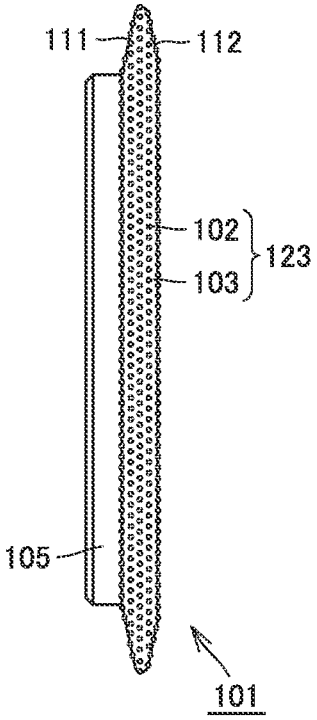
FIG. 2 is a left side view of the diamond rotary dresser for a gear, as seen in a direction indicated in FIG. 1 by an arrow II.

FIG. 2 is a left side view of the diamond rotary dresser for a gear, as seen in a direction indicated in FIG. 1 by an arrow II. Referring to FIG. 2, abrasive grain layer 123 has upper and lower end portions in the form of the letter "V," and two surfaces 111 and 112 are tapered to form a predetermined angle.

Figure 3:
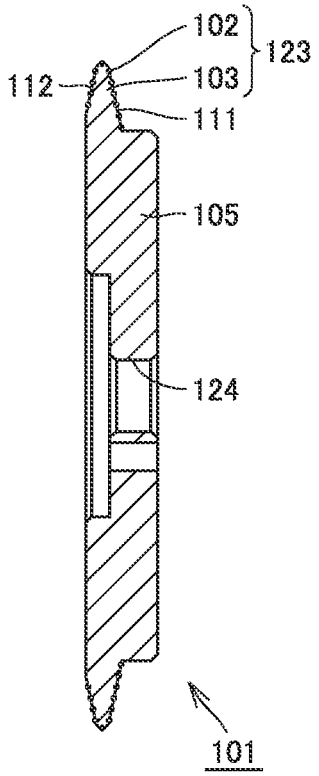
FIG. 3 is a cross-sectional view taken along a line shown in FIG. 1.

FIG. 3 is a cross-sectional view taken along a line shown in FIG. 1. Referring to FIG. 3, tapered surfaces 111 and 112 are composed of abrasive grain layer 123 composed of hard abrasive grains 102 and binder 103. Abrasive grain layer 123 is fixed to core 105.

Figure 4:
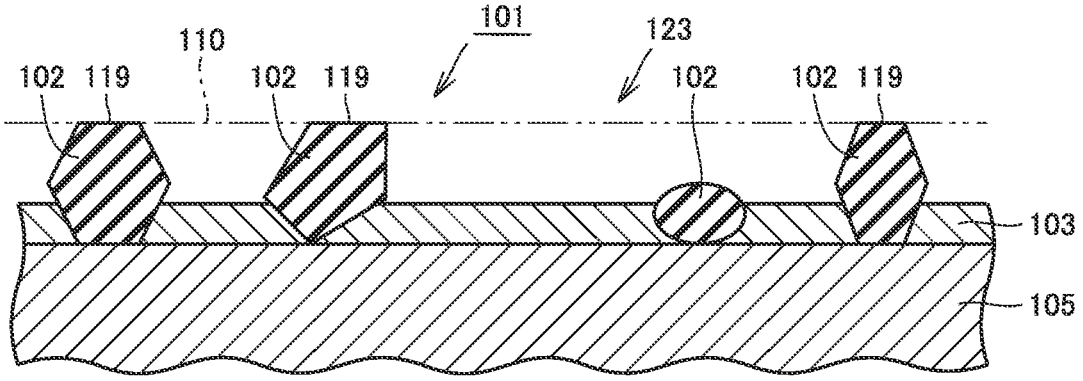
FIG. 4 is a cross-sectional view showing a structure of an abrasive grain layer.

FIG. 4 is a cross-sectional view showing a structure of the abrasive grain layer. Referring to FIG. 4, diamond rotary dresser 101 for a gear as an abrasive tool has abrasive grain layer 123. Abrasive grain layer 123 is formed on core 105. Abrasive grain layer 123 has a plurality of hard abrasive grains 102 and binder 103 for holding diamond abrasive grains. Binder 103 is composed of a single layer of nickel plating. A plurality of hard abrasive grains 102 are bonded via binder 103. A plurality of hard abrasive grains 102 each have a working surface 119 formed to contact a workpiece. A ratio of a total area of a plurality of such working surfaces 119 to an area of an imaginary plane 110 smoothly connecting the plurality of working surfaces 119 is 5% or more and 30% or less. The ratio of 5% or more and 30% or less allows diamond rotary dresser 101 for a gear to have satisfactory sharpness and a long lifetime.

Working surface 119 is obtained by grinding or polishing a surface of hard abrasive grain 102 (that is, providing hard abrasive grains 102 with a uniform height). The ratio of a maximum area and a minimum area (maximum area/minimum area) of the plurality of working surfaces 119 is preferably 1.5 or more and 10 or less.

EXAMPLES (Description of Each Sample)

Various wheels shown in Tables 2-4 were prepared. The wheels are the same in shape and size. The wheels have the shape as shown in FIG. 1 and FIG. 2, and have a diameter of Ø110 mm. Each sample has a differently structured abrasive grain layer.

TABLE 2

| items | effect on performance | comp. ex. 1 | present invention 1 | present invention 2 | present invention 3 | present invention 4 | present invention 5 | comp. ex. 2 |
|---|---|---|---|---|---|---|---|---|
| working surface area ratio | sharpness | 4.3 | 5 | 6.1 | 14 | 25 | 30 | 35 |
| abrasive grain max/min diameter ratio | small: sharpness large: lifetime | 6.25 | 6.25 | 6.25 | 6.25 | 6.25 | 6.25 | 6.25 |
| abrasive grain distribution density | small: lifetime large: sharpness | 204 | 215 | 220 | 201 | 211 | 207 | 210 |
| evaluation | sharpness | A | A | A | A | A | B | C |
| | lifetime | C | B | A | A | A | A | C |
| | summary of result | While sharpness was satisfactory, the abrasive particle layer's shape collapsed severely and accuracy of dressing deteriorated. | | | | | | Sharpness deteriorated early, and accuracy of dressing was unsatisfactory. |

Preferably, a ratio of a maximum diameter to a minimum diameter (maximum diameter/minimum diameter) of the plurality of hard abrasive grains 102 is 1.2 or more and 10 or less. Note that hard abrasive grain 102 is limited to what has working surface 119. In FIG. 4, there is also hard abrasive grain 102 having no working surface, and the grain size of such hard abrasive grain 102 is not taken into consideration. Within this range, a superabrasive wheel can present performance with extremely satisfactory sharpness and lifetime.

Preferably, the plurality of hard abrasive grains 102 are distributed in abrasive grain layer 123 at a density of 50 to 1500 grains/cm$^2$. Hard abrasive grain 102 is limited to what has working surface 119. Within this range, a superabrasive wheel can present performance with extremely satisfactory sharpness and/or lifetime.

Preferably, the plurality of hard abrasive grains 102 have a Vickers hardness Hv of 1000 or more and 16000 or less. Hard abrasive grains having such hardness allow a wheel to be increased in sharpness and lifetime.

Preferably, hard abrasive grains 102 have a grain size of 91 or more and 1001 or less. A wheel having hard abrasive grains with such a relatively large grain diameter remarkably exhibits an effect of increasing sharpness and lifetime.

TABLE 3

| items | effect on performance | comp. ex. 3 | comp. ex. 4 | present invention 6 | present invention 7 | present invention 8 |
|---|---|---|---|---|---|---|
| working surface area ratio | sharpness | 4 | 33 | 18 | 18 | 18 |
| abrasive grain max/min diameter ratio | small: sharpness large: lifetime | 1.1 | 1.1 | 1.1 | 1.2 | 3 |
| abrasive grain distribution density | small: lifetime large: sharpness | 305 | 300 | 303 | 296 | 298 |
| evaluation | sharpness | A | C | B | A | A |
| | lifetime | C | C | A | A | A |
| summary of result | | While sharpness was satisfactory, the abrasive grain layer's shape collapsed early, and accuracy of dressing deteriorated at an early stage. | The load current value varied significantly, and accuracy of dressing also varied. | | | |

| items | effect on performance | present invention 9 | present invention 10 | present invention 11 | comp. ex. 5 | comp. ex. 6 |
|---|---|---|---|---|---|---|
| working surface area ratio | sharpness | 18 | 18 | 18 | 4 | 33 |
| abrasive grain max/min diameter ratio | small: sharpness large: lifetime | 7 | 10 | 11 | 11 | 11 |
| abrasive grain distribution density | small: lifetime large: sharpness | 304 | 307 | 301 | 299 | 296 |
| evaluation | sharpness | A | A | B | B | C |
| | lifetime | A | A | B | C | C |
| summary of result | | | | | The abrasive grain layer's shape collapsed severely, and accuracy of dressing deteriorated at an early stage. | The load current value varied significantly, and accuracy of dressing also varied. |

TABLE 4

| items | effect on performance | comp. ex. 7 | comp. ex. 8 | present invention 12 | present invention 13 | present invention 14 | present invention 15 |
|---|---|---|---|---|---|---|---|
| working surface area ratio | sharpness | 4 | 33 | 10 | 10 | 10 | 10 |
| abrasive grain max/min diameter ratio | small: sharpness large: lifetime | 4 | 4 | 4 | 4 | 4 | 4 |
| abrasive grain distribution density | small: lifetime large: sharpness | 38 | 45 | 41 | 50 | 103 | 307 |
| evaluation | sharpness | C | B | B | A | A | A |
| | lifetime | C | C | B | B | A | A |
| summary of result | | Sharpness Immediately deteriorated | Sharpness gradually deteriorated, | Sharpness gradually deteriorated | While sharpness and | | |

TABLE 4-continued

| | | | | | | | |
|---|---|---|---|---|---|---|---|
| | | and accuracy of dressing deteriorated. | and the abrasive grains were worn faster than that and accuracy of dressing deteriorated. | and in the latter half it was observed that the workpiece was slightly burnt. | accuracy of dressing were satisfactory, in the latter half it was observed that the workpiece was slightly burnt. | | |
| items | effect on performance | present invention 16 | present invention 17 | present invention 18 | present invention 19 | comp. ex. 9 | comp. ex. 10 |
| working surface area ratio | sharpness | 10 | 10 | 10 | 10 | 4 | 33 |
| abrasive grain max/min diameter ratio | small: sharpness large: lifetime | 4 | 4 | 4 | 4 | 4 | 4 |
| abrasive grain distribution density | small: lifetime large: sharpness | 599 | 1014 | 1480 | 1694 | 1676 | 1708 |
| evaluation | sharpness | A | B | B | B | A | C |
| | lifetime | A | A | A | B | C | C |
| | summary of result | | The load current value gradually increased. | The load current value gradually increased. | The load current value gradually increased, and in the latter half it was observed that the workpiece was slightly burnt. | While sharpness was satisfactory, the abrasive grain layer's shape collapsed early, and accuracy of dressing deteriorated at an early stage. | As the product is used, the load current value increased, and accuracy of dressing deteriorated. |

In Tables 2-4, "working surface area ratio" indicates a ratio of a total area of a plurality of working surfaces 119 to an area of imaginary plane 110 smoothly connecting the plurality of working surfaces 119 (in %).

In Tables 2-4, "abrasive grain maximum/minimum diameter ratio" means a ratio of a maximum diameter and a minimum diameter (maximum diameter/minimum diameter) of a plurality of hard abrasive grains 102 (limited to those having working surface 119).

In Tables 2-4, "abrasive grain distribution density" means a distribution density of the plurality of hard abrasive grains 102 (limited to those having working surface 119) (no. of abrasive grains/$cm^2$).

(Method of Controlling Numerical Values in Producing Superabrasive Wheels of Examples)

In producing the various wheels described in Tables 2-4, the time, frequency and the like of grinding or polishing the surfaces of hard abrasive grains were adjusted to control their working surfaces in size to control their area ratio. When increasing the abrasive grains' maximum diameter/minimum diameter value, a plurality of hard abrasive grains having different average diameters mixed as appropriate were used for control, whereas when decreasing the abrasive grains' maximum diameter/minimum diameter value, the abrasive grains to be used were sieved to provide a grain size distribution with a narrower range for control. Abrasive grain distribution density was controlled by adjusting the amount of abrasive grains used for a single wheel.

Tables 2-4 show the thus produced, various wheels' respective working surface area ratios, maximum/minimum abrasive grain diameter ratios, and abrasive grain distribution density values.

These diamond rotary dressers for a gear were used to true and dress a grinding wheel used for processing a gear.

The dressing was done under the following conditions: Target to be dressed: grinding wheel for grinding a gear (material: aluminium oxide grinding wheel)

Dressing Conditions:

Grinding wheel rotation speed: 60 to 80 rpm

Rotary dresser rotation speed: 3000 rpm

Depth of cut: 20 μm/pass (in coarse processing)

Depth of cut: 10 μm/pass (in finishing processing)

The initial dressing is coarse processing and the subsequent dressing is finishing processing.

A result of the dressing was evaluated according to the following criteria:

Comparative Example 2's wheel served as a reference in sharpness and lifetime, and the present invention's wheels were evaluated in performance. With Comparative Example 2's load current value and lifetime being 1.0, evaluation criteria were in three stages of A, B and C, as indicated below.

(Sharpness Evaluation)

Good/bad sharpness was evaluated from a load current value of a dresser driving shaft of a dressing apparatus.

A: The load current value was less than 0.6, and extremely steady dressing was able to be done.

B: The load current value was 0.6 or more and less than 0.8, and steady dressing was able to be done.

C: The load current value was 0.8 or more, and it was difficult to perform steady dressing.

(Lifetime Evaluation)

The precision of a workpiece processed with a dressed grinding wheel was regarded as an accuracy of the dressing, and it was determined that the dresser had reached its end of life when the accuracy of the dressing deteriorated.

A: The accuracy of the dressing substantially unchanged, and the lifetime was 2 or more.

B: The accuracy of the dressing gradually deteriorated and accordingly, the workpiece was slightly burnt, however, the lifetime was 1.2 or more and less than 2.

C: The accuracy of the dressing was poor, and the workpiece was considerably burnt, and the lifetime was less than 1.2.

As is apparent from Tables 2-4, the present invention's examples 1-19 were not evaluated as C in sharpness and lifetime and it has been confirmed that they exhibit satisfactory characteristics. On the other hand, Comparative Examples 1-10 were evaluated as C in either sharpness or lifetime, and it has been confirmed that they present low performance. As shown in Table 2, of the products of the present invention, those having a working surface area ratio of 6 to 25% were evaluated as A in sharpness and lifetime and thus found to be particularly preferable.

As shown in Table 3, of the products of the present invention, those with abrasive grains having maximum/minimum diameter ratio of 1.2-10 were evaluated as A in sharpness and lifetime and thus found to be particularly preferable.

As shown in Table 4, of the products of the present invention, those with abrasive grain distribution density of 100 to 600 grains/cm$^2$ were evaluated as A in sharpness and lifetime and thus found to be particularly preferable.

The present invention is applicable in a field of abrasive tools such as, for example, a superabrasive grinding wheel used to carry out profile grinding on a workpiece, and a diamond rotary dresser used to dress a grinding wheel. In particular, the present invention relates to a diamond rotary, gear dresser used for truing or truing and dressing a grinding wheel used for processing a gear.

It should be understood that the embodiments and examples disclosed herein have been described for the purpose of illustration only and in a non-restrictive manner in any respect. The scope of the present invention is defined by the terms of the claims, rather than the embodiments described above, and is intended to include any modifications within the meaning and scope equivalent to the terms of the claims.

REFERENCE SIGNS LIST

101: diamond rotary dresser for gear; 102: hard abrasive grain; 103: binder; 105: core; 110: imaginary plane; 119: working surface; 123: abrasive grain layer.

The invention claimed is:

1. An abrasive tool having an abrasive grain layer composed of a plurality of hard abrasive grains bonded by a binder, a plurality of the hard abrasive grains each having a working surface formed to contact a workpiece, wherein for each hard abrasive grain of the plurality of hard abrasive grains, the working surface is a planar surface, and the working surface of each hard abrasive grain of the plurality of hard abrasive grains is along an imaginary plane, wherein the plurality of hard abrasive grains consists of at least one selected from the group consisting of diamond and cubic boron nitride, wherein a ratio of a total area of a plurality of such working surfaces to an area of the imaginary plane smoothly connecting the plurality of working surfaces being 5% or more and 30% or less, wherein a second hard abrasive grain not having the working surface is provided on a base between the hard abrasive grains having the working surface, a height from the base to the top of the second hard abrasive grain is lower than a height from the base to the working surface, and wherein the binder is plating.

2. The abrasive tool according to claim 1, wherein a ratio of a maximum diameter to a minimum diameter (maximum diameter/minimum diameter) of a plurality of the hard abrasive grains is 1.2 or more and 10 or less.

3. The abrasive tool according to claim 1, wherein a plurality of the hard abrasive grains are distributed in the abrasive grain layer at a density of 50 to 1500 grains/cm$^2$.

4. The abrasive tool according to claim 1, wherein a plurality of the hard abrasive grains have a Vickers hardness Hv of 1000 or more and 16000 or less.

5. The abrasive tool according to claim 1, wherein the abrasive grain layer is a single layer.

6. The abrasive tool according to claim 1, wherein the binder is nickel plating.

7. The abrasive tool according to claim 1, being a rotary dresser.

8. The abrasive tool according to claim 7, being a disk dresser.

9. The abrasive tool according to claim 7, used for truing or dressing a grinding wheel used for processing a gear.

* * * * *